US010852103B2

(12) United States Patent
Storch

(10) Patent No.: US 10,852,103 B2
(45) Date of Patent: Dec. 1, 2020

(54) MOVABLE FIREARM ACCESSORY SUPPORT ASSEMBLY

(71) Applicant: Midwest Industries, Inc., Waukesha, WI (US)

(72) Inventor: Troy Storch, Wales, WI (US)

(73) Assignee: Midwest Industries, Inc., Waukesha, WI (US)

( * ) Notice: Subject to any disclaimer, the term of this patent is extended or adjusted under 35 U.S.C. 154(b) by 0 days.

(21) Appl. No.: 15/215,682

(22) Filed: Jul. 21, 2016

(65) Prior Publication Data

US 2018/0023924 A1 Jan. 25, 2018

(51) Int. Cl.
*F41G 11/00* (2006.01)
*F41C 27/00* (2006.01)
*F41A 11/04* (2006.01)

(52) U.S. Cl.
CPC ..... *F41G 11/00* (2013.01); *F41A 11/04* (2013.01); *F41C 27/00* (2013.01); *F41G 11/004* (2013.01)

(58) Field of Classification Search
CPC ..... F41C 27/00; F41G 11/00–11/001; F41G 11/003–11/008; F41G 1/17; F41A 11/04
USPC ..... 42/124–128, 90
See application file for complete search history.

(56) References Cited

U.S. PATENT DOCUMENTS 2,073,210 A * 3/1937 Horsrud ..... F41G 11/003 42/126
2,425,130 A * 8/1947 Shelley ..... F41G 11/008 42/127
2,437,363 A * 3/1948 Smith ..... F41G 1/17 42/140
2,529,801 A * 11/1950 Fisk ..... F41G 11/008 108/45
2,545,419 A * 3/1951 Williams ..... F41G 11/006 248/201
7,210,261 B2 * 5/2007 Arachequesne ..... F41G 1/16 42/111
7,219,370 B1 * 5/2007 Teetzel ..... A42B 3/04 2/422
7,552,558 B1 * 6/2009 Ballard ..... F41G 1/01 356/255
8,424,234 B2 * 4/2013 Carlson ..... F41G 11/001 42/125
8,468,735 B1 * 6/2013 Keng ..... F41G 11/004 42/148
8,510,983 B2 * 8/2013 Larue ..... F41G 11/003 42/124
8,793,921 B1 * 8/2014 Tonello ..... F41G 11/003 42/125

(Continued)

*Primary Examiner* — Stephen Johnson
*Assistant Examiner* — Benjamin S Gomberg
(74) *Attorney, Agent, or Firm* — Boyle Fredrickson S.C.

(57) ABSTRACT

A mount assembly for securing accessories to an underlying firearm assembly. The mount assembly includes a base that is constructed to be secured to an underlying firearm and an accessory support that is moveable relative to the base. An interface arrangement is provided between the base and the accessory support such that the accessory support can be rotated relative to the base between a first orientation that is laterally inboard of the base and a second orientation that is laterally outboard of the base to accommodate break-action operation of an underlying firearm when the accessory mount assembly is secured to the firearm.

20 Claims, 10 Drawing Sheets

(56) References Cited

U.S. PATENT DOCUMENTS

| | | | | |
|---|---|---|---|---|
| 8,984,797 | B2 * | 3/2015 | Ballard | F41G 1/00 42/111 |
| 9,417,034 | B1 * | 8/2016 | Swan | F41G 11/008 |
| 9,562,550 | B2 * | 2/2017 | Swan | F41G 11/003 |
| 9,797,688 | B2 * | 10/2017 | Kennair, Jr. | F41G 11/003 |
| 9,936,115 | B2 * | 4/2018 | Tagarro | H04N 5/23203 |
| 2013/0288743 | A1 * | 10/2013 | Hunt | F41G 11/004 455/556.1 |
| 2015/0020429 | A1 * | 1/2015 | Savoy | F41G 11/003 42/111 |
| 2017/0241741 | A1 * | 8/2017 | Campbell | F41G 1/30 |

* cited by examiner

MOVABLE FIREARM ACCESSORY SUPPORT ASSEMBLY

BACKGROUND OF THE INVENTION

The present invention relates generally to mounting arrangements associated with securing sighting accessories to an underlying firearm assembly. More specifically, the present invention relates to an accessory mounting assembly wherein an accessory, such as a lighting or sighting accessory, can be moved between an in-use orientation wherein the accessory can be used for aiming of the firearm and a non-use position wherein the accessory is oriented generally laterally outboard of the line of sight during use of the firearm and such that the mounting arrangement does not interfere with any of the features of the underlying firearm.

Fire arm sight assemblies generally include an ocular or sight that is attached to the firearm to assist the shooter with aligning the bore of the firearm with an intended target. Commonly, the shooter adjusts either the sight relative to the firearm, or the orientation of the sight relative to the target, to accommodate different shooting conditions. For example, if a projectile will be subjected to a crossing wind during the travel of the projectile to the target, the shooter can laterally translate the sight relative to the bore of the firearm, or simply aim the firearm at a sight location that is offset from an intended projectile impact area. These variations in lateral alignment of the sight and/or the firearm with the intended target are commonly referred to as windage adjustments.

Another type of alignment adjustment the shooter must accommodate is an inclination of declination of the firearm relative to the target to accommodate the differences between the generally linear sighting path and the occasionally more curved projectile path. For targets at close range, this is generally a negligible consideration for most shooters as the projectile will follow a substantially linear path. Further still, at closer ranges, some shooters prefer sighting accessories that can be moved to locations that do not otherwise obstruct the line of sight to a target but can reintroduced to the shooting line of sight in a repeatable and expeditious manner to accommodate shooting at targets at various different ranges and without removal of the sighting device from the underlying firearm.

Regardless of the shooting/sighting technique, repeatable alignment of the sight with the firearm when moved between in-use and non-use positions is required for the shooter to be able to repeatedly hit an intended target. Still further, when provided in a movable rather than removable configuration, such sight mounting accessories preferably do not interfere with any of the operational features associated with an underlying firearm. For instance, some firearms, such as the SUB-2000™ rifle offered by Kel Tee Weapons, is provided with a break-action construction. As commonly understood, break-action firearms are constructed such that the barrel can be rotated out of alignment with action and/or stock associated with the remainder of the firearm, and provide a more compact configuration of the firearm when in a stored configuration. With respect to the SUB-2000™ rifle, the axis of rotation associated with the break-action is horizontally oriented such that the axis of rotation extends in a generally lateral direction and is oriented above an action or receiver portion of the rifle such that the barrel folds in an upward and rearward direction relative to the receiver when the firearm is collapsed from an elongated in-use orientation to a stowed or folded orientation.

When folded, the barrel portion of the firearm generally closely overlies the receiver and stock portion of the remainder of the firearm. Sighting or lighting accessories associated with the upper surface of the firearm commonly interfere with or wholly negate the foldable operation of the firearm. To be folded, any accessories associated with the upper surface of the firearm, whether associated with the barrel, receiver, or stock portions of the firearm, must be removed from the firearm prior to folding of the firearm. Understandably, such accessories must also be operationally associated with the firearm with each un-folding and subsequent use of the underlying firearm. Although many removable sighting accessories are available, accurate shooting with such sighting accessories is heavily dependent on the shooters ability to repeatedly orient the sight relative to the firearm. Therefore, there is a need for a moveable rather than removable accessory mounting assembly or system that does not interfere with other features associated with of the underlying firearm.

Although various moveable firearm accessory mounting arrangements that allow sighting accessories to be moved from an in-use orientation to an out of line of sight line orientation relative to the underlying firearm are known, such arrangements suffer from various drawbacks when associated with break-action weapons. A primary benefit of most break-action firearms is the reduced elongated footprint of the weapon when in the folded orientation. Although some known movable accessory mounting arrangements may accommodate folding of the underlying firearm, most such configurations leave the mounting arrangement, and any accessory associated therewith, at orientations that are laterally outboard of a vertical footprint of the folded firearm.

These outboard orientations of the mounting arrangements and/or any accessories associated therewith, leave the mounting arrangement and any accessories associated therewith in a cantilevered orientation relative to the underlying firearm when the firearm is in a folded orientation. The outboard and/or cantilevered orientations leaves the accessory mounting arrangement, and any accessory associated therewith, exposed to vibrational and impact forces that can detrimentally affect operability of the mounting arrangement, the accessory, and/or the repeatability with which the accessory can be associated with the underlying firearm between uses. As such, there is a further need for a firearm accessory mounting arrangement or system wherein the mounting arrangement and/or an accessory associated therewith can be maintained in close proximity to the underlying firearm such that the more robust structure of underlying firearm preferably provides some degree of protection of the mounting arrangement and/or the accessory when the firearm is in a collapsed or folded configuration.

SUMMARY OF THE INVENTION

The present invention discloses a firearm accessory mounting assembly and method of forming a firearm mounting assembly that overcomes one or more of the aforementioned drawbacks. One aspect of the invention discloses an accessory mounting assembly that includes a base that is constructed to be secured to an underlying firearm and an accessory support that is moveable relative to the base. An interface arrangement is provided between the base and the accessory support such that the accessory support can be rotated relative to the base between a first orientation that is laterally inboard of the base and a second orientation that is laterally outboard of the base to accommodate break-action of an underlying firearm when the accessory mounting assembly is secured to the firearm. The accessory mounting assembly is constructed to achieve the first orientation when the firearm is in use and when the firearm is in folded orientation such that the accessory support, and an accessory associated therewith, is at least partially surrounded by structure of the adjacent fire arm.

Another aspect of the invention that includes or is combinable with one or more of the above features associated with the above aspect discloses a firearm accessory mount assembly that includes a base that is constructed to be secured to an underlying firearm. An accessory support is pivotably connected to the base such that the accessory support is moveable relative to the base and the underlying fire arm. An interface arrangement is formed between the base and the accessory support and allows the accessory support to be rotated about an axis of rotation between a first orientation that is laterally inboard of the base and a second orientation that is laterally outboard of the base and such that a plane associated with the first orientation and the second orientation is substantially normal to the axis of rotation.

A further aspect of the invention that is useable or combinable with one or more of the above aspects or features discloses a moveable gun sight mount assembly that includes a post having a first end that is constructed to be secured to a firearm and defines an axis of rotation that is oriented in a generally vertical direction. A sight mount is attached to the post such that the sight mount is rotatable about the axis of rotation between a first position wherein a portion of the sight mount overlies a barrel of the firearm and a second position in a generally common plane with the first position wherein the portion of the sight mount is laterally outboard of the barrel of the firearm.

Another aspect of the invention that is useable or combinable with one or more of the above features or aspects discloses a method of forming a movable firearm accessory mount. The method includes providing a base portion that is constructed to be secured to a firearm. An accessory mount portion is provided that movably cooperates with the base portion such that the accessory mount portion is rotatable relative to the base portion between a first position, associated with both use of an accessory during use of the firearm and interfering with unfolding of the firearm, and a second position wherein the accessory mount portion is oriented laterally outboard of a cross-section associated with motion of the barrel relative to a receiver during unfolding of the firearm.

These and various other aspects, features, and advantages of the present invention will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

Figure 1:
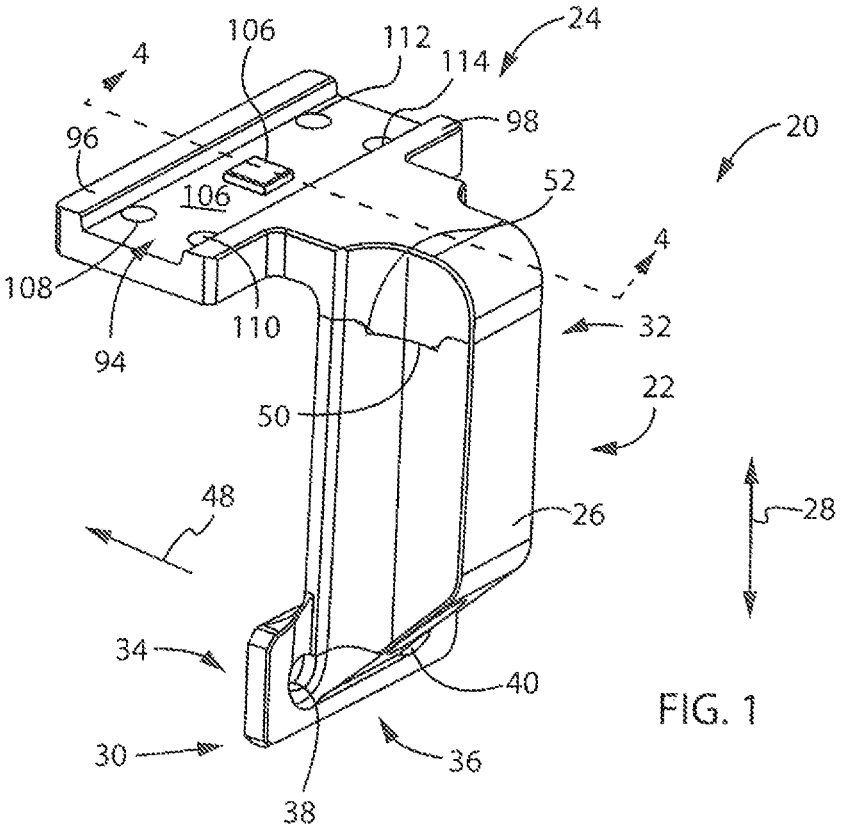
FIG. 1 is a laterally outboard perspective view of a firearm accessory mounting assembly according to the present invention.
Figure 2:
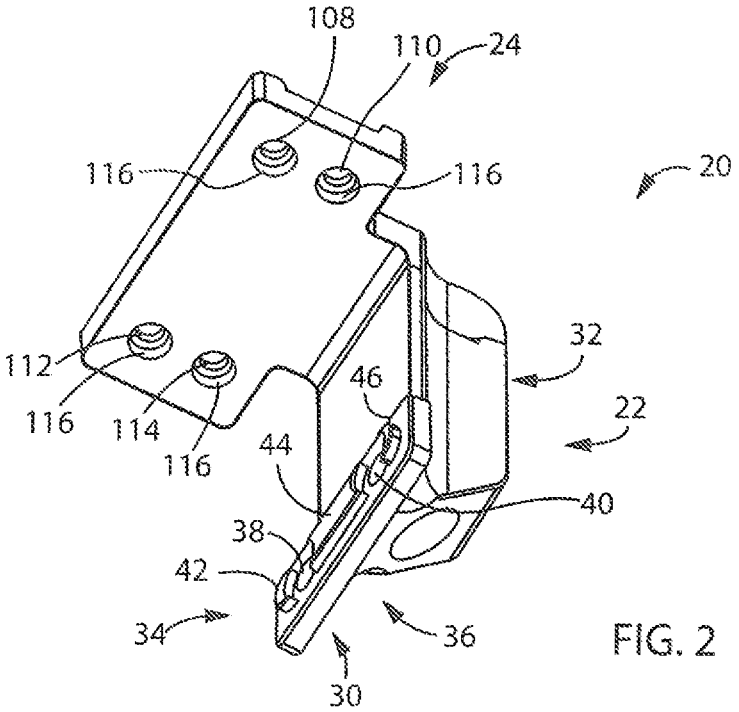
FIG. 2 is a lower firearm facing perspective view of the firearm accessory mounting assembly shown in FIG. 1.
Figure 3:
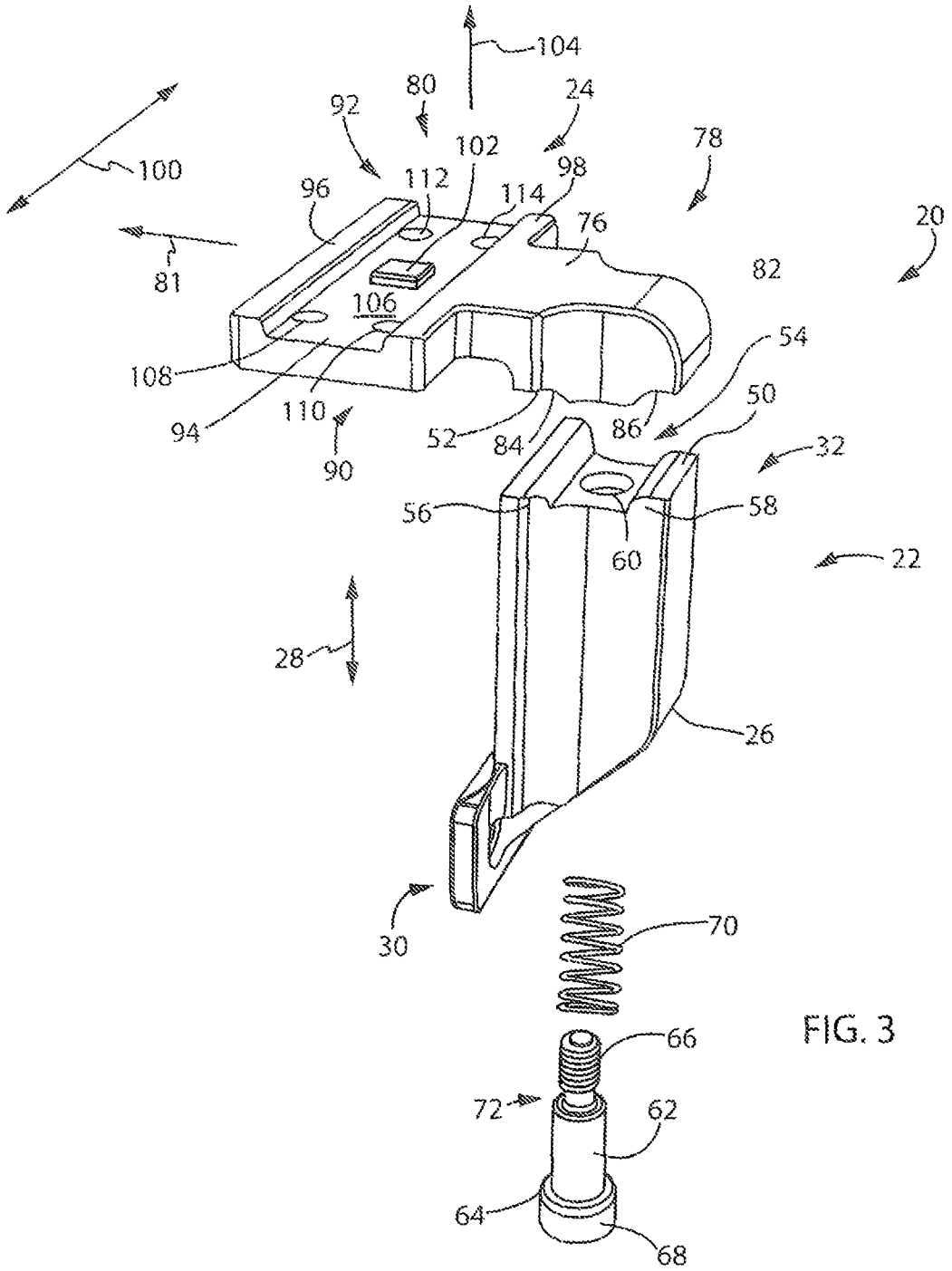
FIG. 3 is a perspective exploded view of the mounting assembly shown in FIG. 1.

FIGS. 1-3 show a firearm accessory mount or mounting assembly, referred to hereafter as mount assembly 20, according to the present invention. Mount assembly 20 includes a post or base 22 and a sight or accessory mount or accessory mounting portion or accessory support 24 that is attached to base 22 so as to be moveable relative thereto. Base 22 is generally defined by an elongate body 26 that extends in a generally longitudinal direction, indicated by arrow 28, between a first end portion 30 and a second end portion 32 of body 26. First end portion 30 of base 22 include a laterally inboard or firearm facing side 34 and a laterally outboard facing side 36 that is generally opposite thereto. One or more openings 38, 40 are formed through body 26 proximate first end portion 30. As disclosed further below with respect to FIGS. 7-13, openings 38, 40 are oriented and constructed to cooperate with respective fasteners associated with securing mount assembly 20 relative to an underlying firearm.

One or more projections 42, 44, 46 (FIG. 2) extend in an inboard lateral direction, indicated by arrow 48 (FIG. 1), relative to end portion 30. As disclosed further below with respect to FIGS. 7-13, projections 42, 44, 46 are oriented and constructed to cooperate with a corresponding structure associated with the underlying firearm to achieve the desired orientation of base 22 relative to a firearm to which it is secured. It is appreciated that numbers and orientations of openings 38, 40 and/or projections 42, 44, 46, other than those shown can be provided to accommodate indexing and securing of mount assembly 20 relative to an underlying firearm when mount assembly 20 is secured thereto.

Second end portion 32 of base 22 defines an upwardly directed surface 50 that is configured to cooperate with a downwardly directed surface 52 defined by accessory support 24. Surface 50 of base 22 generally defines a channel 54 that is disposed between a pair of ridges 56, 58 associated with second end portion 32 of base 22. An opening or passage 60 extends through base 22 in longitudinal direction 28 and is disposed in channel 54 associated with base 22. Passage 60 is shaped to slideably cooperate with a shank portion 62 a fastener 64 that cooperates with passage 60. Fastener 64 includes a threaded portion 66 and a head portion 68 that are disposed at generally opposite longitudinal ends of fastener 64. As disclosed further below with respect to FIGS. 4-6, threaded portion 66 of fastener 64 is configured to operatively engage accessory support 24 such that accessory support 24 is attached to base 22 and rotational relative thereto.

A biasing device, such as a spring 70, slideably cooperates with fastener 64 and is shaped to be disposed generally between head portion 68 and a transition 72 formed between shank portion 62 and threaded portion 66 of fastener 64 when mount assembly 20, is assembled. As disclosed further below, biasing device 70 biases surfaces 50, 52 associated with base 22 and adapter support 24 into engagement with one another. However, the force associated with biasing device 70 can be manually overcome such that a separation or gap can be formed between surfaces 50, 52 and accessory support 24 can be rotated about an axis defined by fastener 64 relative to base 22. As disclosed further below, the rotational operative relation between base 22 and accessory support 24 allows mount assembly 20 to provide various orientations of discrete accessories relative to the underlying firearm while mount assembly 20 is secured thereto and does not unduly interfere with the functionality of an underlying firearm assembly as disclosed further below.

Accessory support 24 is generally defined by a body 76 that includes a first portion 78 that generally overlies base 22 and a second portion 80 that extends in an outward lateral direction, indicated by arrow 81, relative to first portion 78. Surface 52 of accessory support 24 includes at least one projection 82 that is disposed between a pair of laterally outward directed contours or recesses 84, 86 such that surface 50 of base 22 and surface 52 of accessory support 24 maintain the orientation of accessory support 24 relative to base 22 in at least two discrete positions or relative orientations when surfaces 50, 52 are in contact with one another, as disclosed further below. It is appreciated that surfaces 50, 52 could be provided in other shapes and/or configures that cooperate with one another to define other numbers of secure positional orientations of accessory support 24 relative to base 22. Regardless of their specific construction, surfaces 50, 52 associated with base 22 and accessory support 24 define an interface arrangement between base 22 and accessory support 24 that is operable to allow translation of accessory support 24 relative to base 22 and a secure positional interaction therebetween when engaged with one another.

Second portion 80 of accessory support 24 includes a firearm facing surface 90 and an accessory facing surface 92 that is disposed opposite thereof. Accessory facing surface 92 includes a channel 94 that is disposed between a pair of ridges 96, 98. Channel 94 and ridges 96, 98 extend in a longitudinal direction, indicated by arrow 100, that is generally aligned with the longitudinal direction (159; FIGS. 7-10) associated with an underlying firearm assembly when mount assembly 20 is secured thereto as disclosed further below. A projection 102 extends in a generally outward upward direction, indicated by arrow 104, relative to a surface 106 or bed of channel 94. One or more openings 108, 110, 112, 114 extend through second portion 80 of accessory support 24 in direction 28.

As shown in FIG. 2, a counter bore 116 is associated with each of openings 108, 110, 112, 114, and configured to seat a head portion of a fastener associated therewith. Channel 94; ridges, 96, 98; projection 102; and openings 108, 110, 112, 114, are constructed to accommodate securing of an accessory, such as a sighting or optics device, relative to mount assembly 20 and such that an axis of operation 204 associated with the respective optic or other accessory is generally aligned with axis 100 when a desired accessory is secured thereto. It is appreciated that accessory facing surface 92 associated with second portion 80 could be provided in a variety of shapes or contours and with any number of fastener openings configured to accommodate securing discrete accessories relative thereto. It is further appreciated that accessory mounts having different constructions could be provided wherein each accessory mount is configured to cooperate with a discrete accessory, or class of accessories, and base 22. It is appreciated that when provided in such a modality, changing of an accessory associated with a respective firearm can be facilitated by replacing accessory support 24 with an alternate accessory support 24 while base 22 remains secured to the underlying firearm assembly.

Figure 4:
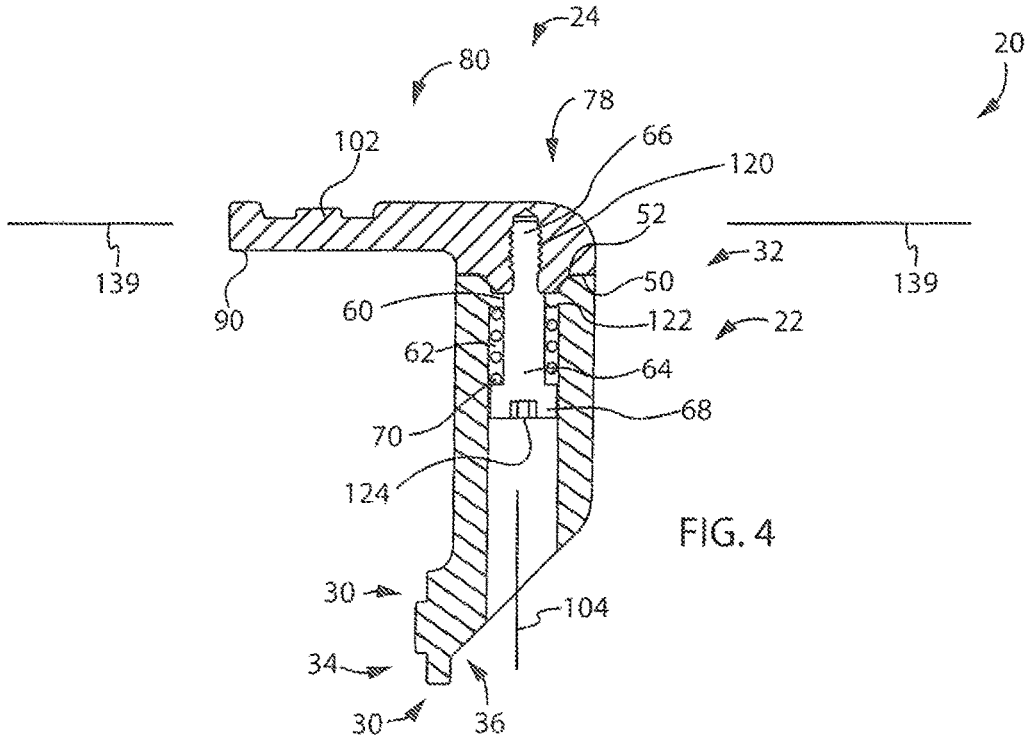
FIG. 4 is an elevation cross section view of the mounting assembly shown in FIG. 1 taken alone line 4-4.
Figure 5:
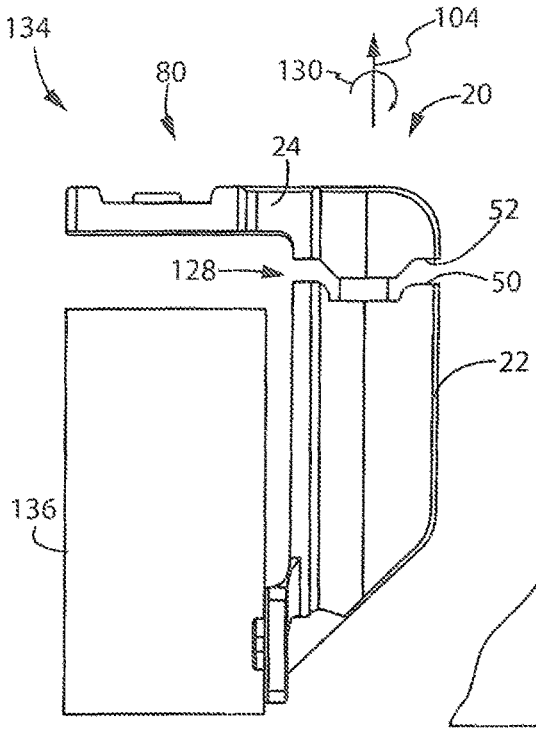
FIG. 5 is a side elevation view of the mounting assembly shown in FIG. 1 with an accessory support oriented in a first position relative to a base of the mounting assembly.
Figure 6:
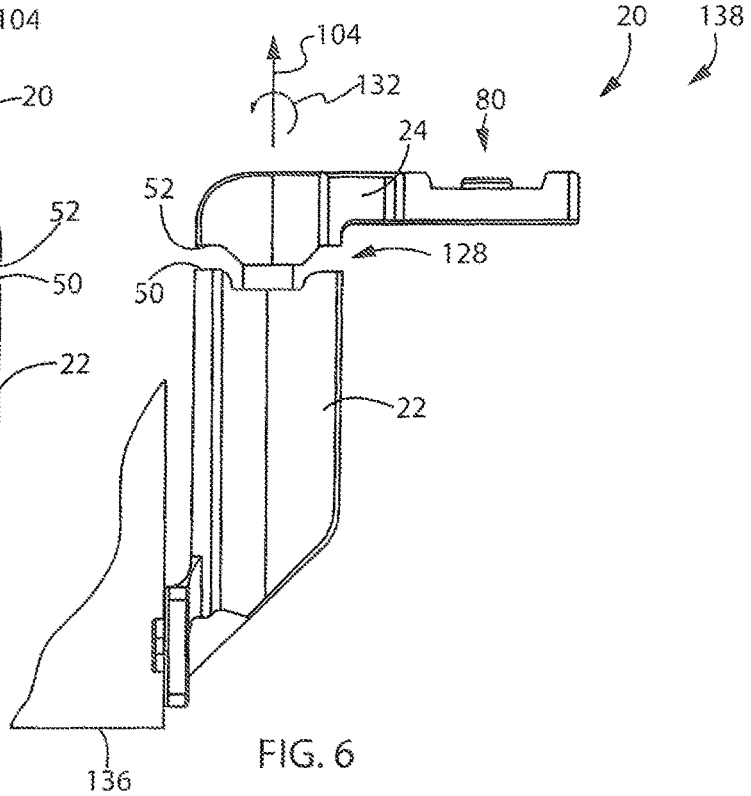
FIG. 6 is a view similar to FIG. 5 and shows the accessory support oriented in a second position relative to the base of the mounting assembly.

Referring to FIGS. 4-6, when assembled, threaded portion 66 of a fastener 64 cooperates with a threaded cavity 120 associated with first portion 78 of accessory support 24. Passage 60 associated with base 22 is shaped to slideably cooperate with a shank portion 62 of fastener 64 and such that spring 70 is captured between a ledge 122 defined by body 26 of base 22 and head portion 68 of fastener 64. Spring 70 is configured to bias surface 52 of accessory support 24 into engagement with surface 50 of base 22. Head portion 68 of fastener 64 includes a drive arrangement, such as a hex shaped recess 124, associated with securing fastener 64 with threaded cavity 120 of accessory support 24 during assembly.

The orientation of base 22 relative to accessory support 24 as shown in FIGS. 1,2, and 4 is generally understood as an in-use or laterally inboard orientation of accessory support 24 of mount assembly 20 relative to base 22 and an underlying firearm assembly. When accessory support 24 is oriented in the laterally inboard orientation relative to base 22 and the underlying firearm assembly, second portion 80 of accessory support 24 generally overlies the barrel portion or operational axis associated with a line of sight associated with use of the underlying firearm.

Referring to FIGS. 5 and 6, manual translation of accessory support 24 in direction 104 relative to base 22 and over the bias associated with spring 70 forms a gap 128 between surface 50 defined by base 22 and surface 52 defined by accessory support 24. Rotation of accessory support 24 in a rotational direction, indicated by arrows 130, 132, about the axis of rotation 104 associated with fastener 64 allows second portion 80 of accessory support 24 to rotate relative to base 22 between a first or laterally inboard position or orientation 134 wherein the second portion 80 of accessory support 24 generally overlies a vertical cross-section footprint 136 defined by an underlying firearm assembly and a laterally outboard orientation 138 relative to footprint 136 of the underlying firearm assembly. Upon the respective laterally inboard or outboard rotation of accessory support 24 relative to base 22, spring 70 biases accessory support 24 into engagement with base 22 until surfaces 50, 52 creating a touching or contact engagement. The shape and/or contour associated with surfaces 50, 52 allows accessory support 24 to index relative to base 22 such that the longitudinal axis 100 is generally aligned with the longitudinal or operational axis, indicated by line 159 (FIGS. 7-10), associated with the underlying firearm assembly whether accessory support 24 is oriented in the laterally inboard orientation 134 or the laterally outboard orientation 138 relative to base 22. It should be appreciated that, although aligned when in either orientation, axis 100 is offset further from the axis of operation 159 defined by a barrel of an underlying firearm assembly when accessory support 24 of mount assembly 20 is oriented in the laterally outboard orientation 138 relative to base 22 as compared to laterally inboard orientation 134. It should further be appreciated that accessory support 24 is oriented in a common plane, indicated by line 139 (FIG. 4), that is generally parallel to an axis defined by a bore of an underlying firearm assembly when in the first and second orientations 134, 138.

Whether oriented in the laterally inboard or laterally outboard orientations 134, 138, such a consideration allows utilization of mount assembly 20, and an accessory associated therewith, in both line of sight operations associated with securely orienting optics or sites relative to a line of sight associated with use of an underlying firearm assembly as well as other uses. For instance, when the accessory is provided as light, some users may prefer use of such accessories when oriented in either of the inboard, and/or laterally outboard orientations 134, 138. Still further, mount assembly 20 provides an accessory mounting arrangement or configuration that accommodates and/or does not otherwise unduly interfere with the functionality associated with some classes or configurations of firearm assemblies.

FIGS. 7-13 show various views of mount assembly 20 having an exemplary firearm accessory, in the form of a sighting optic 150, associated with an exemplary underlying firearm or firearm assembly 152. It is appreciated that accessory 150 and firearm assembly 152 could be provided in any number of modalities, constructions, and/or configurations aside from that which is described below. It is further appreciated that mount assembly 20 can be configured to cooperate with other accessories, such as flashlights or the like, usable when the mount assembly is oriented in either of the first orientation 134 or the second orientation 138 depending upon the preferences of discrete users.

Figure 7:
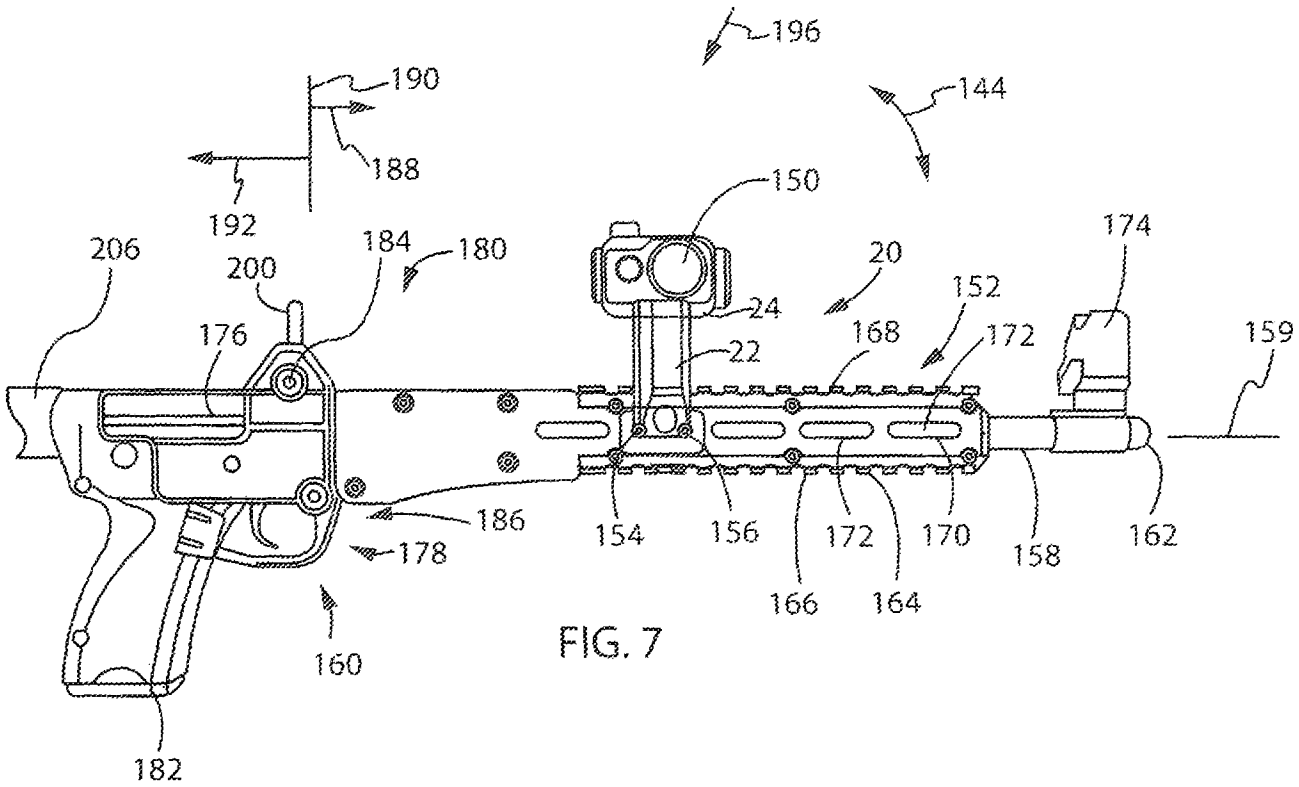
FIG. 7 is a side elevation view of the mount assembly shown in FIG. 1 oriented in a first orientation and associated with an exemplary firearm assembly and accessory.
Figure 8:
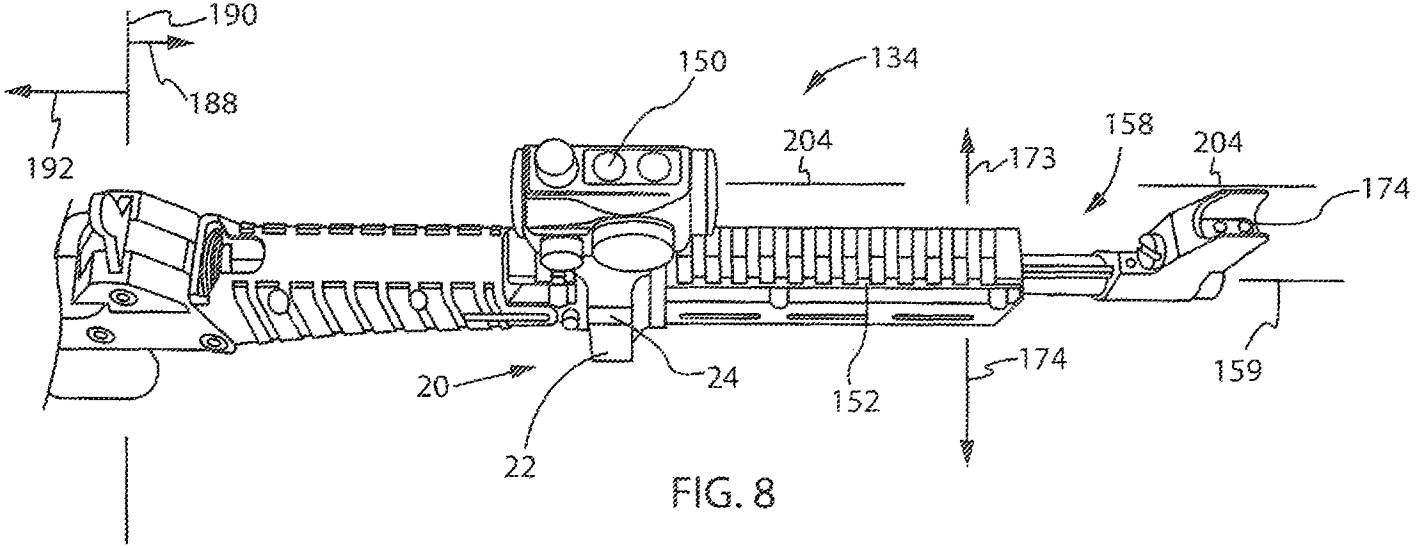
FIG. 8 is a top perspective view of the mount assembly shown in FIG. 1 in the first orientation and associated with the underlying firearm assembly.

Referring to FIGS. 7 and 8, first and second connectors or fasteners 154, 156 cooperate with the previously described openings 38, 40 associated with first end portion 30 of base 22 to secure base 22 relative to firearm assembly 152. As with many firearm assemblies, firearm assembly 152 includes a barrel 158 that extends between a rearward portion of the underlying firearm assembly 152 or a receiver assembly 160 and a muzzle 162. A fore grip, such as a handguard or handguard assembly 164, is generally disposed about a rearward portion of barrel 158 and is constructed to mitigate contact between the user and barrel 158 during use of firearm assembly 152 and provides a secure operator hand placement. Handguard assembly 164 includes one or more engagement interfaces 166, 168, 170 that extend in a generally longitudinal direction relative thereto.

Engagement interfaces, 166, 168, 170 are constructed to accommodate securing of accessories, such as mount assembly 20, relative to the underlying firearm assembly 152. Engagement interface 170 is defined by a number of generally elongated channels or grooves 172, or other such structure, configured to allow secure interaction between the respective accessories and the underlying handguard assembly 164. Referring briefly to FIGS. 2, 7, and 8, projections 42, 44, 46 associated with base 22 of mount assembly 20 are constructed to cooperate with a respective or respective portions of adjacent grooves 172 defined by engagement interface 170 such that mount assembly 20 can be secured thereto via fasteners 154, 156. Understandably, engagement interfaces 166, 168, 170 can be provided in a number of configurations. End portion 30 associated with base 22 can be readily configured to cooperate with many such configurations.

Figure 10:
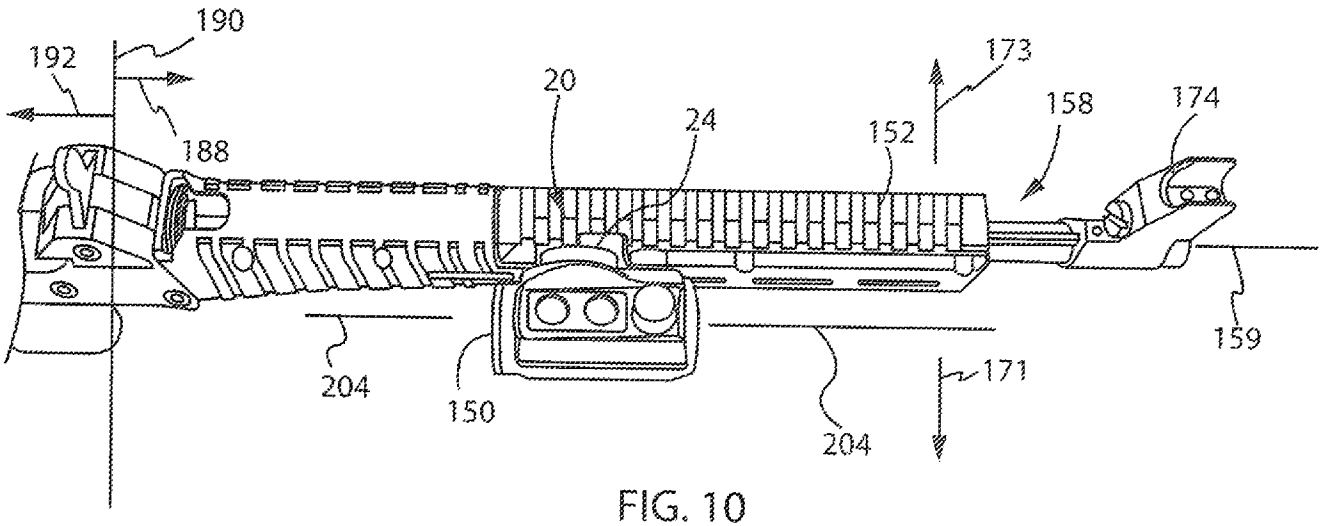
FIG. 10 is a view similar with FIG. 8 with the mount assembly oriented in the second orientation relative to the underlying firearm assembly.

Referring briefly to FIGS. 8 and 10, it can be appreciated that mount assembly 20 is shown attached to what is commonly referred to as a right hand facing lateral side, as indicated by arrow 171, relative to firearm assembly 152. It is appreciated that mount assembly 20 could be secured to a left hand facing lateral side, as indicated by arrow 173, of firearm assembly 152 to accommodate different shooter preferences. Referring also to FIG. 7, it is further appreciated that mount assembly 20 could be secured to firearm assembly 152 at longitudinal positions along firearm assembly 152 other than that shown to further accommodate the preferences of discrete users with respect to the position of accessory 150 and/or the desired interaction with mount assembly 20 when secured to firearm to achieve the operability described further below.

Referring back to FIGS. 7-8, in many configurations, firearm assembly 152 includes a forward sight 174 that is commonly secured directly to barrel 158 and associated with operation of firearm assembly 152. Receiver assembly 160 commonly includes an action 176, a trigger assembly 178, and is constructed to cooperate with a rearward oriented portion 180 of barrel 158. In many configurations wherein firearm assembly 152 is configured for multi-round or semi-automatic operation, a magazine 182 is provided that cooperates with receiver assembly 160 to facilitate the repeatable operation firearm assembly 152. In the configuration shown in FIG. 7-13, firearm assembly 152 is provided in a configuration commonly referred to as a breach or break-action. When provided in such configurations, barrel 158 and/or handguard assembly 164 associated with the underlying firearm assembly 152 are constructed to pivotably cooperate with receiver assembly 160, via a pivot 184, or other such structure, and a catch 186, or other such structure, configured to allow the selective pivotable or rotational motion of the barrel 158 relative to the receiver assembly 160.

Figure 11:
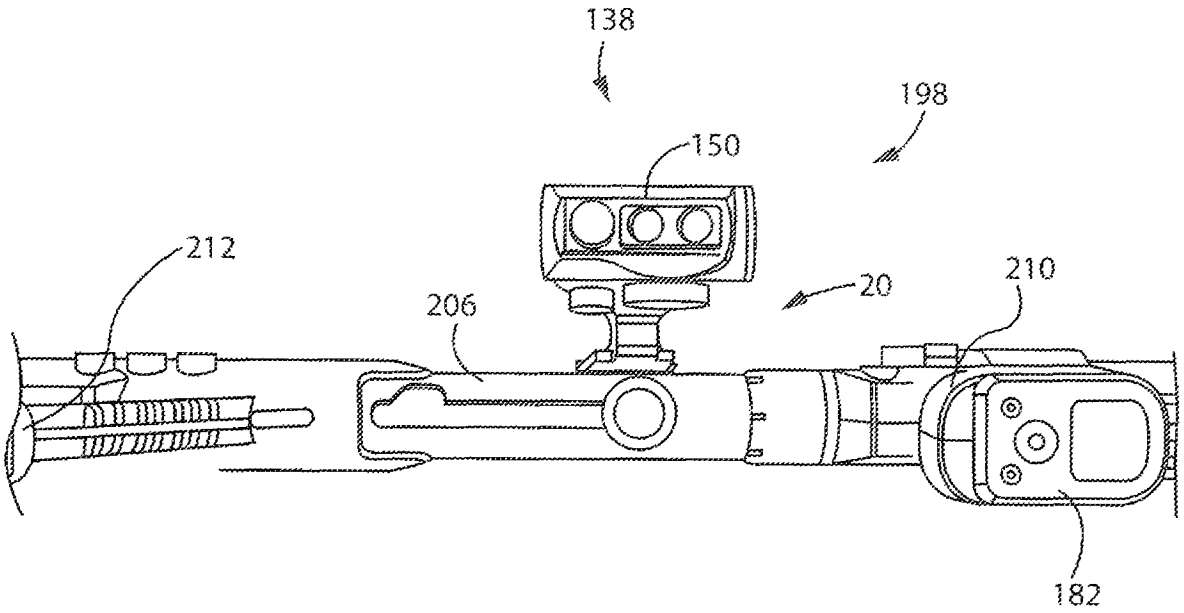
FIG. 11 is a bottom plan view of the mount assembly associated with the firearm assembly shown in FIGS. 7-10 with the firearm assembly in a folded orientation and the mount assembly oriented in the second orientation when a barrel portion of the underlying firearm assembly folded in a collapsed configuration relative the remainder of the firearm assembly.
Figure 12:
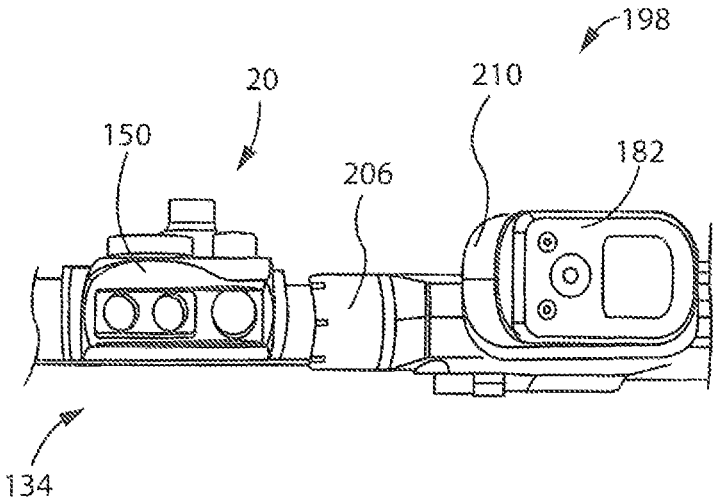
FIG. 12 is a bottom plan view similar to FIG. 11 with the mount assembly oriented in the first orientation relative to the underlying folded firearm assembly.
Figure 13:
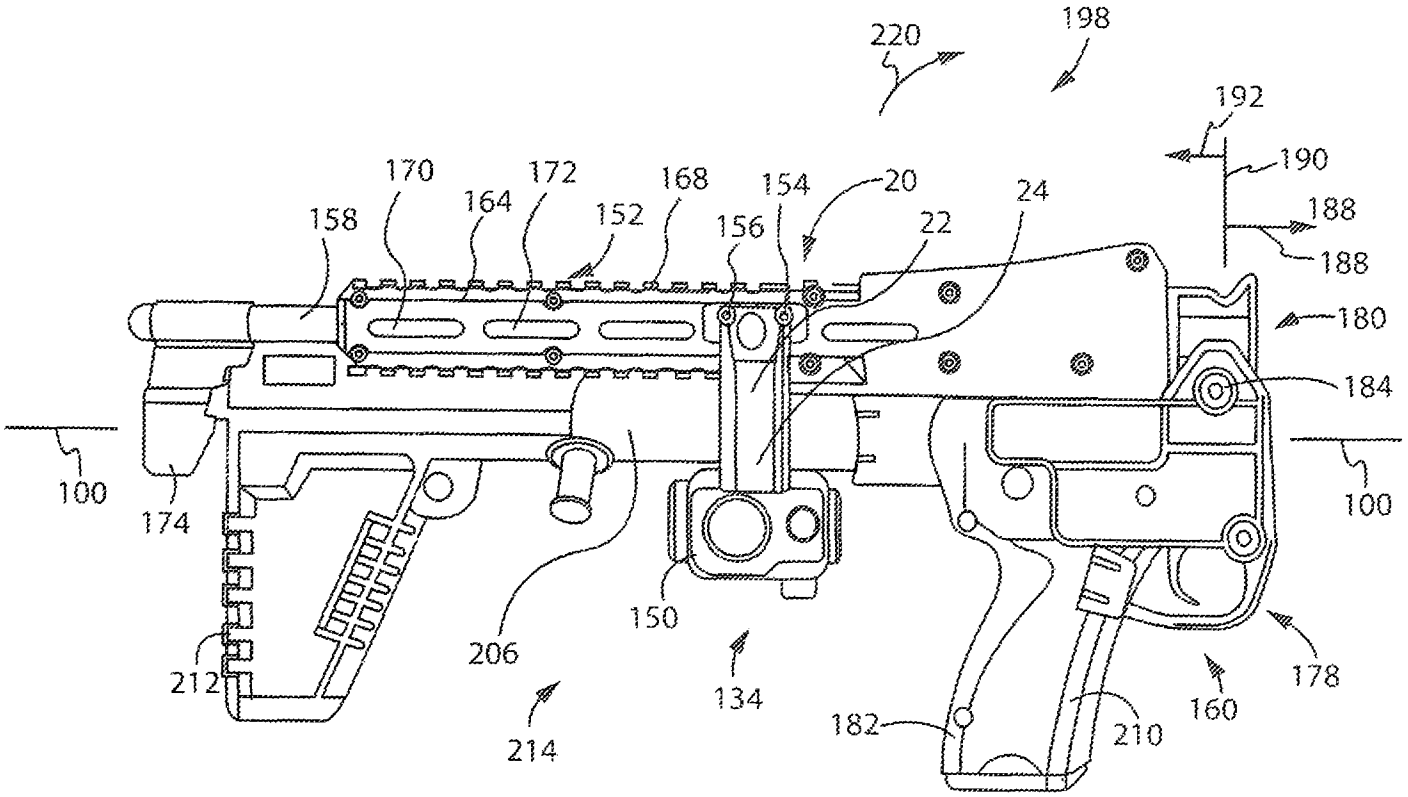
FIG. 13 is a side elevation view of the mount assembly and folded firearm assembly in the respective relative stowed and folded orientations shown in FIG. 12.

Actuation of catch 186 allows relative rotation about an axis, indicated by line 190, between a forward oriented portion, indicated by arrow 188, of firearm assembly 152, and a rearward oriented portion, indicated by arrow 192, of firearm assembly 152. In the configuration shown in FIGS. 7-13, forward oriented portion 188 of firearm assembly 152 is rotatable in a generally vertically oriented plane or direction, indicated by line 194, relative to rearward oriented portion 192 of firearm assembly 152 to facilitate the folding and unfolding of firearm assembly 152 via rotation of the respective portions 188, 192 relative to one another about axis 190. Such a construction allows firearm assembly 152 to achieve an in-use orientation 196, as shown in FIGS. 7-10, and a stowed or inoperable or folded orientation 198, as shown in FIGS. 11-13. The ability of firearm assembly to be folded and unfolded is a substantial feature associated with the desirability of such firearm assemblies.

Even though foldable, many such firearm assemblies commonly include a rear sight 200 that is associated with receiver assembly 160 or a rearward oriented portion 180 of handguard assembly 164. Rear sight 200 is oriented to cooperate with forward sight 174 for sighting of firearm assembly 152. Rear sight 200 is commonly collapsible or otherwise movable so as to not interfere with the foldable and unfoldable operation of the underlying firearm assembly even through rear sight is commonly permanently affixed to firearm assembly. Although shown as what can be consider a vertically operable break-action firearm, it is appreciated that mount assembly 20 is constructed to cooperate with break-action firearm assemblies having other constructions such as lower or vertically oriented axis of rotation associated with the break-action operation of the respective firearm assemblies.

Still referring to FIGS. 7-8, when mount assembly 20 is oriented in the laterally inboard orientation 134 relative to a firearm assembly 152, axis of operation, indicated by line 204, associated with accessory 150 is generally aligned with the axis of operation 159 associated with use of the underlying firearm assembly 152. It should be appreciated that when oriented in laterally inboard orientation 134, accessory support 24 is oriented relative to base 22 in the configuration shown in FIG. 5 aside from the absence of gap 128 via the bias action associated with spring 70. As shown in FIGS. 5 and 8, when oriented in orientation 134, a substantial portion of accessory support 24 generally overlies the vertical and horizontal footprint associated with underlying firearm assembly 152.

Figure 9:
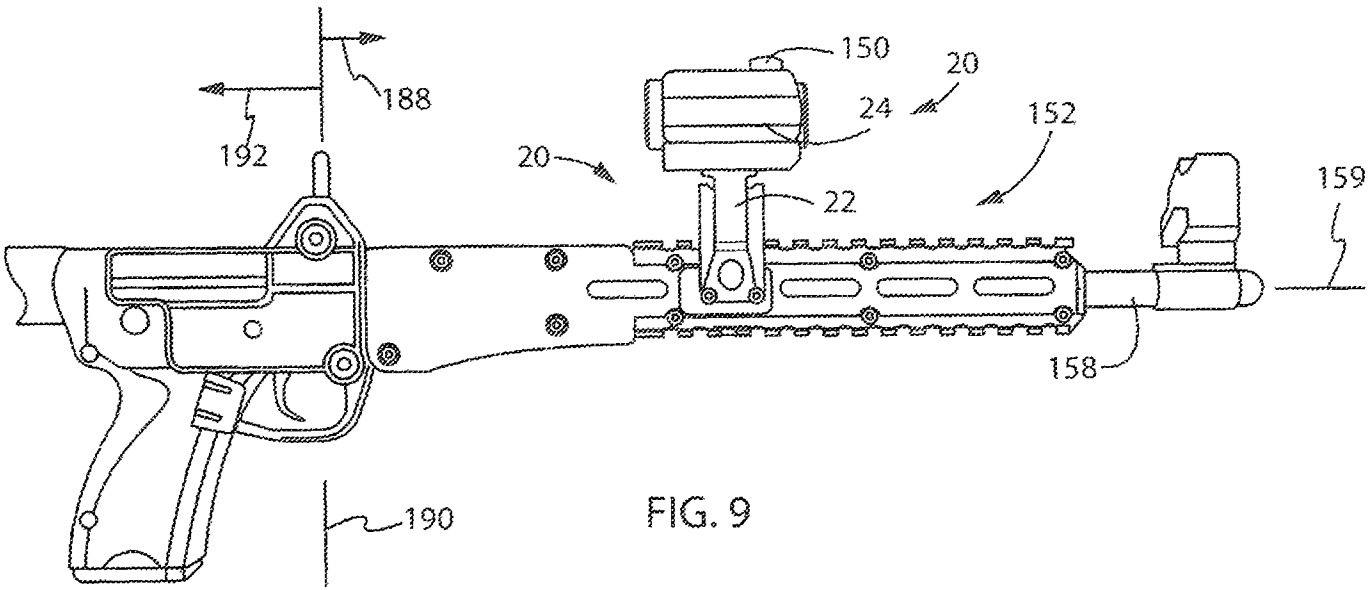
FIG. 9 is a view similar to FIG. 7 with the mount assembly oriented in a second orientation relative to the underlying firearm assembly.

Referring to FIGS. 9 and 10, when it is desired that accessory 150 be oriented laterally outboard relative to the axis of operation 159 associated with firearm assembly 152; either for unobstructed use of sights 174, 200; laterally outboard use of accessory 150; or folding of firearm assembly 152; accessory support 24 can be translated a generally vertical direction 104 to create gap 128 (FIGS. 5-6) between surfaces 50, 52 such that accessory support 24 can be rotated relative to base 22 in either of a forward or rearward direction relative to base 22 and underlying firearm assembly 152. Such manipulation achieves the laterally outboard orientation 138 of accessory 150 (FIG. 10), and thereby the laterally outboard orientation associated with operational axis 204 of accessory 150, relative to the operational axis 159 defined by the underlying firearm assembly 152.

As disclosed above, depending on upon the modality associated with operation or use of accessory 150, users may prefer the laterally inboard or laterally outboard orientation of accessory support 24 relative to firearm assembly 152 to achieve a desired use or non-use of accessory 150 and/or the underlying firearm assembly 152. That is, when accessory 150 is provided as a flashlight, some users may prefer use of such an accessory when accessory support 24 is oriented in either or both of orientations 134, 138 as a function of user preferences and/or shooting situations. It is further be noted that, when oriented in the laterally inboard orientation 134 as shown in FIGS. 7-8, mount assembly 20 at least partial interferes with the foldable functionality associated with the underlying firearm assembly 152. That is, firearm assembly 152 would be rendered only partly foldable toward the stowed orientation as described below due to impingement of accessory 150 upon the rearward oriented structures associated with firearm assembly 152. Comparatively, when oriented in the laterally outboard orientation 138 shown in FIGS. 9-10, mount assembly 20, and any respective accessory 150 associated therewith, is oriented laterally outboard relative to firearm assembly 152 such that the portions 188, 192 of firearm assembly 152 can achieve the fully folded orientation as disclosed further below. When in the folded orientation, forward portion 188 of firearm assembly 152 are oriented in generally close and overlying proximity to the rearward oriented portions 192 of firearm assembly 152.

Referring to FIGS. 11-13, when folded, forward portion 188 of firearm assembly 152 generally overlies the rearward portions 192 thereof. The laterally outboard orientation of mount assembly 20, accessory support 24, and an accessory 150 associated therewith, provide full functionality associated with the foldability of firearm assembly 152. It should further be appreciated that when the firearm assembly 152 is oriented in the folded orientation as shown in FIG. 11, mount assembly 20 is oriented in the laterally outboard orientation as shown in FIG. 6 such that accessory support 24 and the accessory 150 associated therewith remain in a substantially laterally outboard orientation relative to the underlying folded firearm assembly 152. Such an orientation leaves mount assembly 20, and any accessory 150 associated therewith, exposed to incidental contact and/or impact associated with transport and/or storage associated with the accessory equipped firearm assembly 152.

Referring to FIGS. 12-13, when firearm assembly 152 is oriented in the folded orientation as shown, accessory support 24 can be rotated relative to base 22 such that a substantial portion or majority of accessory support 24, and an accessory 150 associated therewith, generally overlie the vertical footprint defined by firearm assembly 152. Referring to FIG. 13, receiver assembly 160 commonly includes a pistol grip or grip 210 disposed proximate trigger assembly 178. A stock assembly or simply a stock 206 commonly includes a rearward or butt portion 212. Grip 210 and butt portion 212 extend in a generally downward vertical direction relative to the axis of operation 159 associated with firearm assembly 152.

In many firearm configurations, grip 210 and butt portion 212 of stock 206 commonly define a cavity 214 formed therebetween. When firearm assembly 152 is oriented in the folded orientation 198 and mount assembly 20 is oriented in the laterally inboard orientation 134, accessory 150 and a substantial portion of accessory support 24 are oriented in cavity 214 such that, when considered from the forward and rearward directions associated with longitudinal direction 159, accessory 150 is substantially surrounded by the lower projecting portions associated with the more robust structures of firearm assembly 152. Such considerations improve protection of accessory 150 and mount assembly 20 from incidental contact and/or impacts associated with storage and/or transport a firearm assembly 152. Such considerations enhance the repeatability with which firearm assembly 152 can be folded and unfolded and accessory support 24 and an accessory 150 associated therewith can be positioned relative to the firearm assembly to achieve one or more of the previously established inboard or outboard oriented desired operational positions. Further, disposing a portion of stock 206 between accessory support 24 and an accessory 150 associated therewith and barrel 158 and/or handguard assembly 164, within a vertical perimeter defined by structures of the firearm assembly, mitigates incidental and/or unintentional unfolding of firearm assembly 152 from the folded orientation 198.

From the stowed or storage orientation associated with the configuration of firearm assembly 152 and mount assembly 20 as shown in FIG. 13, rotation of accessory support 24 relative to base 22 from the laterally inboard orientation 134 to the laterally outboard orientation 138 relative to the underlying firearm assembly 152 facilitates unfolding a firearm assembly 152 such that the forward portion 188 of firearm assembly 152 can be rotated in direction 220 relative to rearward oriented portion 192 of firearm assembly 152 for subsequent use of firearm assembly 152 with accessory 150 in the orientation shown in FIGS. 9-10. From the orientation of accessory support 24 relative to base 22 shown in FIGS. 9-10, accessory support 24 can be subsequently rotated from the laterally outboard orientation 138 shown in FIG. 6 to the laterally inboard orientation shown in FIG. 5. Such manipulation achieves the relative orientation of firearm assembly and accessory support orientation shown in FIGS. 7-8 wherein axis 204 associated with accessory 150 is generally aligned with, albeit above, axis 159 associated with operation of firearm assembly 152.

Mount assembly 20 according to the present invention provides firearm accessory mounting arrangement that allows a shooter to quickly and repeatably configure a firearm assembly for shooting with the assistance of an accessory or displacement of the accessory in a generally lateral direction relative to a line of sight associated with use of the firearm assembly. Mount assembly 20 is further configured to generally seamlessly integrate into any of a number of firearm constructions. Mount assembly 20 can also be integrated or augmented and/or supplemented with the use of other sighting accessories such as scopes, lasers, target magnifiers, or the like. The robust construction of mount assembly 20 ensures product longevity and the ability to withstand the inhospitable conditions frequently associated with use of such firearms. Mount assembly 20 is further constructed to be simple to operate such that novice shooters can quickly become accurate marksman across at least a substantial portion of a tactical range of any firearm equipped with such a system and does so in a manner that does not interfere with or negate functionality associated with an underlying firearm assembly.

Therefore, one embodiment includes a mount assembly for securing accessories to an underlying firearm assembly. The mount assembly includes a base that is constructed to be secured to an underlying firearm and an accessory support that is moveable relative to the base. An interface arrangement is provided between the base and the accessory support such that the accessory support can be rotated relative to the base between a first orientation that is laterally inboard of the base and a second orientation that is laterally outboard of the base to accommodate movability of a respective accessory without obstructing break-action operation of an underlying firearm when the accessory mount assembly is secured to the firearm assembly.

Another embodiment that is useable or combinable with one or more of the above features, aspects, or embodiments includes an accessory mounting assembly that includes a base that is constructed to be secured to an underlying firearm and an accessory support that is moveable relative to the base. An interface arrangement is provided between the base and the accessory support such that the accessory support can be rotated relative to the base between a first orientation that is laterally inboard of the base and a second orientation that is laterally outboard of the base. The accessory mounting assembly is constructed to achieve the first orientation when the firearm assembly is in use and when the firearm is in folded orientation such that the accessory support, and an accessory associated therewith, is at least partially surrounded by structure of the adjacent firearm assembly.

Another embodiment that is useable or combinable with one or more of the above features, aspects, or embodiments includes a firearm accessory mount assembly having a base that is constructed to be secured to an underlying firearm. An accessory support is pivotably connected to the base such that the accessory support is moveable relative to the base and the underlying fire arm. An interface arrangement is formed between the base and the accessory support and allows the accessory support to be rotated about an axis of rotation between a first orientation that is laterally inboard of the base and a second orientation that is laterally outboard of the base and such that a plane associated with the first orientation and the second orientation is substantially normal to the axis of rotation.

A further embodiment that is useable or combinable with one or more of the above aspects, features, or embodiments includes a moveable gun sight mount assembly that includes a post having a first end that is constructed to be secured to a firearm and defines an axis of rotation that is oriented in a generally vertical direction. A sight mount is attached to the post such that the sight mount is rotatable about the axis of rotation between a first position wherein a portion of the sight mount overlies a barrel of the firearm and a second position in a generally common plane with the first position wherein the portion of the sight mount is laterally outboard of the barrel of the firearm.

Another embodiment that is useable or combinable with one or more of the above features, aspects, or embodiments includes a method of forming a movable firearm accessory mount. A base portion is provided that is constructed to be secured to a firearm. An accessory mount portion is provided that movably cooperates with the base portion such that the accessory mount portion is rotatable relative to the base portion between a first position, associated with both use of an accessory during use of the firearm and interfering with unfolding of the firearm, and a second position wherein the accessory mount portion is oriented laterally outboard of a cross-section associated with motion of the barrel relative to a receiver during unfolding of the firearm.

The present invention has been described in terms of a preferred embodiment directed to an assembly as generally shown in the drawings. It is recognized that equivalents, alternatives, and modifications, aside from those expressly stated, the summarized embodiments, or the embodiment shown in the drawings, are possible and within the scope of the appending claims. The appending claims cover all such alternatives and equivalents.

What is claimed is:

1. A firearm accessory mount assembly comprising:

a base defined by a body that defines a longitudinal axis of the base between a first end and a second end, the base being configured to be secured to an underlying firearm such that the base extends along a lateral side of the underlying firearm and the longitudinal axis of the base is vertically oriented relative to a bore of the underlying firearm when the bore of the underlying firearm is horizontal, the base comprising an opening configured to receive a fastener for securing the base to the lateral side of the underlying firearm and a projection configured to extend laterally inboard relative to the underlying firearm to cooperate with a corresponding structure associated with the underlying firearm to achieve an orientation of the base relative to the firearm, wherein the projection is integral with the base;

an accessory support that is pivotably connected to the base, the accessory support having an accessory facing surface configured to secure a firearm accessory; and an interface arrangement between the base and the accessory support that allows the accessory support to be rotated about an axis of rotation between a first orientation wherein the accessory facing surface is laterally inboard of the base relative to the underlying firearm and a second orientation wherein the accessory facing surface is laterally outboard of the base relative to the underlying firearm and such that a plane associated with the first orientation and the second orientation is substantially normal to the axis of rotation, wherein each of the base and the accessory support are laterally outboard of the underlying firearm without overlying the bore of the underlying firearm when in the second orientation.

2. The firearm accessory mount assembly of claim 1 wherein the accessory facing surface comprises a sight interface formed on a surface of the accessory support that is configured to index the firearm accessory that is further defined as an optic relative to the accessory support.

3. The firearm accessory mount assembly of claim 1 wherein the axis of rotation is generally aligned with the longitudinal axis of the base.

4. The firearm accessory mount assembly of claim 1 further comprising a biasing device associated with a connector and oriented to bias the accessory support into engagement with the base.

5. The firearm accessory mount assembly of claim 1 wherein the interface arrangement is further defined as at least one of a groove and a ridge formed in the base and the other of a groove and a ridge formed in a surface of the accessory support that overlaps the base.

6. The firearm accessory mount assembly of claim 5 wherein the at least one of the groove and the ridge formed in the base and the other of the groove and the ridge formed in the accessory support extend in a longitudinal direction that is aligned with the bore of the underlying firearm when the base is secured thereto.

7. The firearm accessory mount assembly of claim 1 wherein the accessory facing surface comprises a projection which extends upward relative to a surface of a channel that is disposed between a pair of ridges.

8. The firearm accessory mount assembly of claim 1 wherein the interface arrangement comprises a spring which slideably cooperates with a fastener connector.

9. The firearm accessory mount assembly of claim 8 wherein the spring and the connector are vertically oriented relative to the bore of the underlying firearm when the bore of the underlying firearm is horizontal.

10. The firearm accessory mount assembly of claim 9 wherein the spring and the connector comprise the only spring and the only connector of the interface arrangement.

11. The firearm accessory mount assembly of claim 1 wherein the base has a length that allows the accessory support to be oriented in the first position during use of the firearm and when a rear stock of the firearm is disposed between the accessory support and the barrel of the firearm when the firearm is collapsed to an inoperable position.

12. A moveable gun sight mount assembly comprising:

a post defined by a body having a first end configured to be secured directly to a lateral side surface of a firearm, the first end comprising an opening configured to receive a fastener for securing the body to a side of the firearm and a projection configured to extend laterally inboard relative to the firearm to cooperate with a corresponding structure associated with the firearm to achieve an orientation of the post relative to the firearm, wherein the projection is integral with the post;

an axis of rotation defined by the post and oriented in a generally vertical direction;

a sight mount attached to the post, the sight mount having an accessory facing surface configured to secure a gun sight, the sight mount being attached to the post such that the sight mount is rotatable about the axis of rotation between a first position wherein the accessory facing surface extends laterally beyond an inner most surface of the post and overlies a barrel of the firearm and a second position that is in a common plane with the first position and wherein the accessory facing surface is laterally outboard of the barrel of the firearm; and a connector configured to cooperate with the post and the sight mount, the connector being configured to extend through the body of the post along the lateral side surface of the firearm, wherein the connector operatively engages the sight mount to attach the sight mount to the post while allowing rotation of the sight mount with respect to the post about the axis of rotation, wherein each of the post, the sight mount, and the accessory facing surface are laterally outboard of the firearm without overlying the barrel of the firearm when in the second position.

13. The movable gun sight mount assembly of claim 12 further comprising a biasing device supported by the connector and oriented to bias the sight mount into engagement with the post.

14. The moveable gun sight mount assembly of claim 12 wherein the accessory facing surface includes an index arrangement configured to orient the gun sight that is formed as an optic relative to the sight mount.

15. The moveable gun sight mount assembly of claim 12 wherein the post has a length that allows the sight mount to be oriented in the first position during use of the firearm and when a rear stock of the firearm is disposed between the sight mount and the barrel of the firearm when the firearm is collapsed to an inoperable position.

16. A method of forming a movable firearm accessory mount, the method comprising:

providing a base portion configured to be secured directly to a lateral side of a handguard and configured so that the base portion extends along the lateral side of the handguard and is entirely laterally outboard of an underlying firearm when secured thereto, the base portion comprising an opening configured to receive a fastener for securing the base portion to a side of the underlying firearm and a projection configured to extend laterally inboard relative to the underlying firearm to cooperate with a corresponding structure associated with the underlying firearm to achieve an orientation of the base portion relative to the firearm, wherein the projection is integral with the base;

providing an accessory mount portion that movably cooperates with the base portion, the accessory mount portion having an accessory facing surface for securing an accessory, the accessory mount portion movably cooperates with the base portion such that the accessory mount portion is rotatable relative to the base portion about an axis of rotation between a first position associated with both use of the accessory during use of the firearm and interfering with unfolding of the firearm wherein the accessory facing surface is laterally inboard of an entirety of the base portion relative to the underlying firearm and a second position wherein the accessory facing surface is oriented laterally outboard of an area defined by motion of a barrel relative to a receiver during unfolding of the firearm; and providing a connector portion configured to cooperate with the base portion and the accessory mount portion, the connector portion extending through the base portion along the lateral side of the handguard, wherein the connector portion operatively engages the accessory mount portion to attach the accessory mount portion to the base portion while allowing rotation of the accessory mount portion with respect to the base portion about the axis of rotation, wherein each of the base portion and the accessory mount portion are laterally outboard of the firearm without overlying the handguard when in the second position.

17. The method of claim 16 further comprising forming an index engagement interface between the base portion and the accessory mount portion that restrains the accessory mount portion in a respective one of the first position and the second position.

18. The method of claim 17 further comprising biasing the index engagement interface into engagement to selectively restrict rotation of the accessory mount portion relative to the base portion.

19. The method of claim 16 further comprising biasing the base portion and the accessory mount portion into engagement with one another.

20. The method of claim 16 further comprising the accessory mount portion forming at least one projection to index the accessory relative thereto.

* * * * *